United States Patent [19]

Omholt

[11] Patent Number: 4,993,783

[45] Date of Patent: Feb. 19, 1991

[54] MERCHANDISE DISPLAY UNIT

[76] Inventor: Bruce Omholt, 1034 Holly, Rohert Park, Calif. 94928

[21] Appl. No.: 434,722

[22] Filed: Dec. 1, 1989

[51] Int. Cl.[5] ..... A47F 3/14

[52] U.S. Cl. ..... 312/119; 312/234

[58] Field of Search ..... 312/118, 119, 234, 138.1

[56] References Cited

U.S. PATENT DOCUMENTS

| | | | |
|---|---|---|---|
| 353,770 | 12/1886 | Wormser | 312/119 |
| 542,629 | 7/1895 | Dempsey | 312/119 |
| 997,512 | 7/1911 | Schermerhorn | 312/119 |
| 1,108,985 | 9/1914 | Friedrich | 312/119 |
| 1,156,644 | 10/1915 | Vetter | 312/119 X |
| 1,594,995 | 8/1926 | Brawner et al. | 312/118 |
| 1,662,885 | 3/1928 | Dell | 312/234 X |
| 1,866,511 | 7/1932 | McKee et al. | 312/118 X |

*Primary Examiner*—Joseph Falk

*Attorney, Agent, or Firm*—Donald L. Beeson

[57] ABSTRACT

A merchandise display unit of the type that provides a front display visible at a distance has a substantially vertical removable display wall (31) backed by a fixed partition wall (29) both of which divide the unit's enclosure into a relatively shallow front display area (25) and a relatively deep and secure rear storage area (27). The display wall is removable through a top access door (37) over the display area and is covered with carpet (55) or other hook-and-loop compatible material to which Velcro or the like will adhere. Merchandise items, such as empty video cassette boxes (36) having Velcro fasteners, can be adhered to the display wall in any desired display arrangement while the rear storage area can be used for high density storage of inventory.

7 Claims, 4 Drawing Sheets

MERCHANDISE DISPLAY UNIT

BACKGROUND OF THE INVENTION

The present invention generally relates to point of sale merchandising, and more particularly to merchandising counters which have both a front display and a storage capability.

Heretofore, it is known to provide a merchandising counter which has a front display visible at a distance by potential customers walking in the vicinity of the counter. Typically the merchandising counter will have a glassed-in front display area in which the merchandised product is both stored and displayed. In such counters the display area takes up substantially the entire volume of the counter and is accessed through sliding panel doors at the back of the counter; a salesperson stands behind the counter and retrieves product from the display area for sale over the counter. One particular problem presented by such designs occurs in merchandising environments involving high unit volumes of sales and consequently large storage requirements. An example is merchandising counters used for the sale of video games in high traffic shopping malls. In such merchandising environments, the counter will typically be manned by a single salesperson who periodically will have to leave the counter to replenish inventory causing the counter to be shut down for intervals of time which, although short, are sufficient to have a significant impact on the potential profitability of the counter. Storage is limited in the display unit since high packing densities cannot be achieved in a manner that is consistent with the display purposes of the counter.

Another difficulty with conventional merchandising counters is security While the counters are normally only accessible from the back, merchandisers often experience thefts because the glass panels of the display area can be pried loose relatively easily and the merchandise simply removed through the front of the counter.

The merchandise display unit of the present invention overcomes the above-described drawbacks of conventional counter designs by providing an effective display environment which can be seen at a distance together with a segregated out-of-view high density storage area within the same unit. The invention also provides improved security by eliminating potential front access to the saleable product For instance, in the case of video cassettes, it is contemplated that, in accordance with the invention, empty video cassette boxes will be used in the display area, while the actual saleable product will be stored in a secured storage area. In this event, if the glass front of the display area is penetrated, access will only be had to the empty display boxes and not to the product inventory.

SUMMARY OF THE INVENTION

Briefly, the invention involves a merchandise display unit having a display unit enclosure which is divided into a front display area and a separate secured rear storage area by a partitioning display wall means positioned internally of the enclosure. In the preferred embodiment, the display area is relatively shallow as compared to the secured storage area to provide ample inventory storage space.

The partitioning display wall means includes a substantially vertical display wall positioned behind a glassed-in display opening in the front wall area of the enclosure. The display wall is also provided with merchandise attachment means for removably attaching display merchandise, such as empty video cassette boxes, to the wall behind the front display opening. The attachment means can suitably be a carpet or fabric material covering the display wall so that display items having a backing strip of a hook-and-loop fasterner material, e.g. Velcro, can be adhered easily thereto. It will be understood that other attachment means could be provided, such as a pegboard arrangement wherein display items can be held by pre-positioned pegs in the pegboard.

Further in accordance with the invention, access is provided to the display wall of the partitioning display wall means for positioning or interchanging display merchandise. This is done by means of a display area access opening in the unit's enclosure, preferably in the top front end of the enclosure over the display area. This access opening is in turn preferably covered by a hinged access door secured by one or more keyed locks. In the preferred embodiment the display wall itself is removable through the top access opening; a non-removable partition wall provided behind the removable wall and forming part of the partitioning display wall means provides security between the front display area and the rear storage area when the display wall is removed.

It is therefore a primary object of the invention to provide a merchandise display unit which provides high density storage capabilities while at the same time providing a very effective display environment. It is also an object of the invention to provide a display environment wherein display samples are securely segregated from the saleable inventory. It is a further object of the invention to provide an effective display environment which can be accessed easily for changing the display. Yet other objects of the invention will be apparent from the following specification and claims.

DETAILED DESCRIPTION OF THE ILLUSTRATED EMBODIMENT

Figure 7:
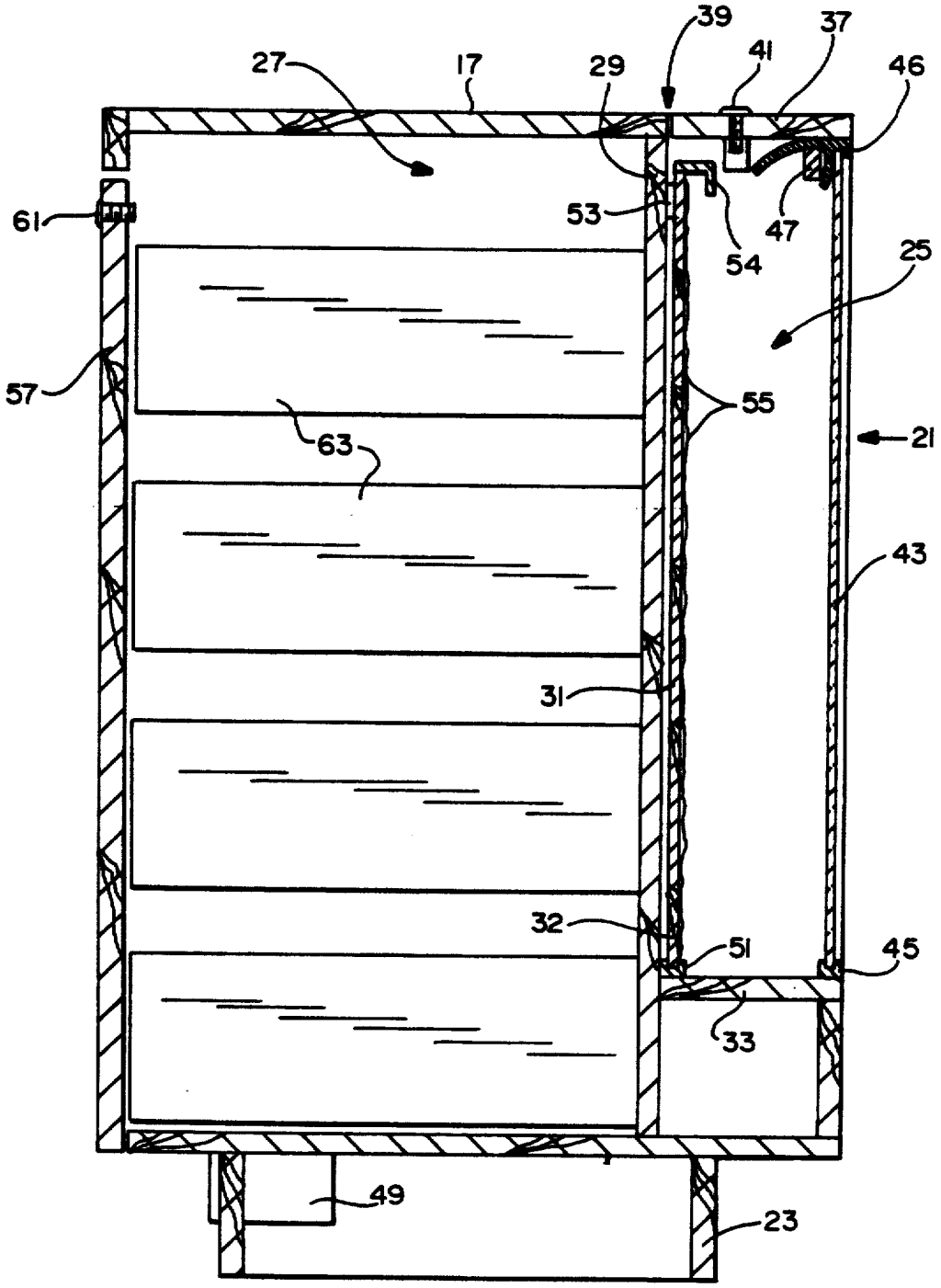
FIG. 7 is a cross-sectional view thereof taken along line 7—7 of FIG. 5.

Referring now to the drawings, a merchandise display unit 11 is formed by an overall enclosure 13 which includes side walls 15 and a top 17, and a generally defined front wall area 19 having a defined display opening 21. The enclosure sits atop a base 23 and, as best seen in FIG. 7, is partitioned into a front display area 25 and a rear storage area 27 by a partitioning display wall means comprised of vertical partition wall 29 and vertical display wall 31 positioned lengthwise within the enclosure. As shown the vertical display wall and adjacent partition wall are positioned relatively close behind the display opening 21 such that the display area 25 is relatively shallow in relation to the storage area 27 behind the display wall. It will be appreciated that the display wall and partition wall can be moved relative to the display opening to enlarge the display area and correspondingly shrink the storage area, however, it is contemplated in most cases that a shallow display area will be sufficient for display purposes and that maximum storage area will be desired. It will also be appreciated that an additional shallow display area could be added to the top of the enclosure over the storage area for, in the manner of some conventional counters, displaying merchandise through the counter top to customers browsing at the counter.

Because it is desirable to provide as expansive a display area as possible in front of the secured storage area, the front display area is seen to extend over substantially the entire width and height of the enclosure. The front display area is bounded at the bottom by a display wall floor 33 and at the top by an access opening 35 covered by an access door 37 which is hinged at 39 near the back of the display area and is securable such as by key lock 41. Again as best seen in FIG. 7, the glass panel 43 covering the display opening 21 is held at its bottom and sides by suitable panel framing channels 45 and at the top by a cross-bar element 46 which can be placed over the glass panel and secured to the sides of the enclosure after the glass panel is installed in the framing channels. The cross-bar member also holds a low voltage display light 47 which is wired to a remote transformer 49 suitably secured in the base of the enclosure through a small diameter conduit (not shown) running up the interior side of the display area.

Figure 1:
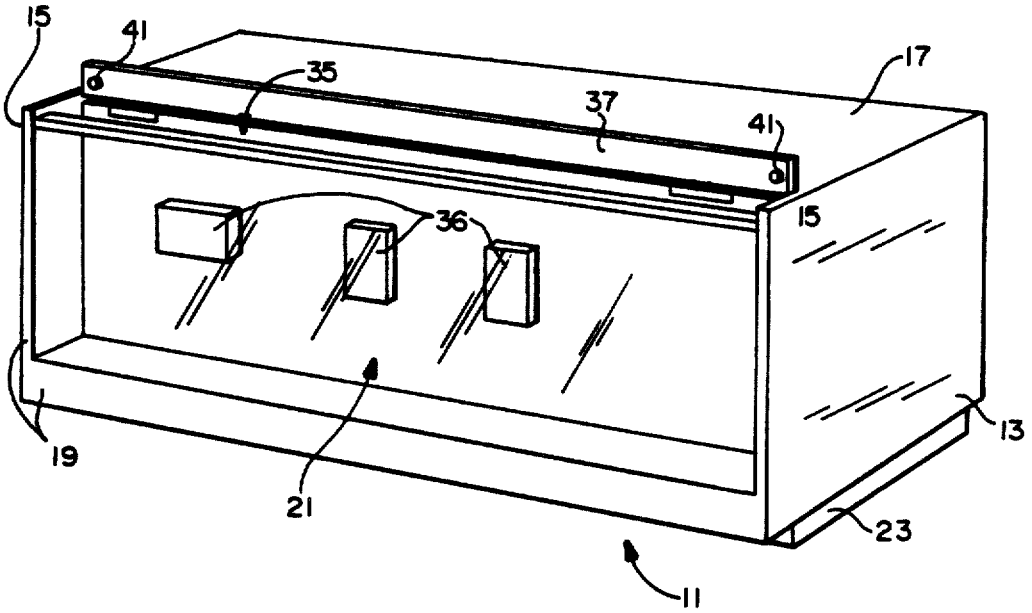
FIG. 1 is a perspective view of a merchandise display unit in accordance with the invention.
Figure 2:
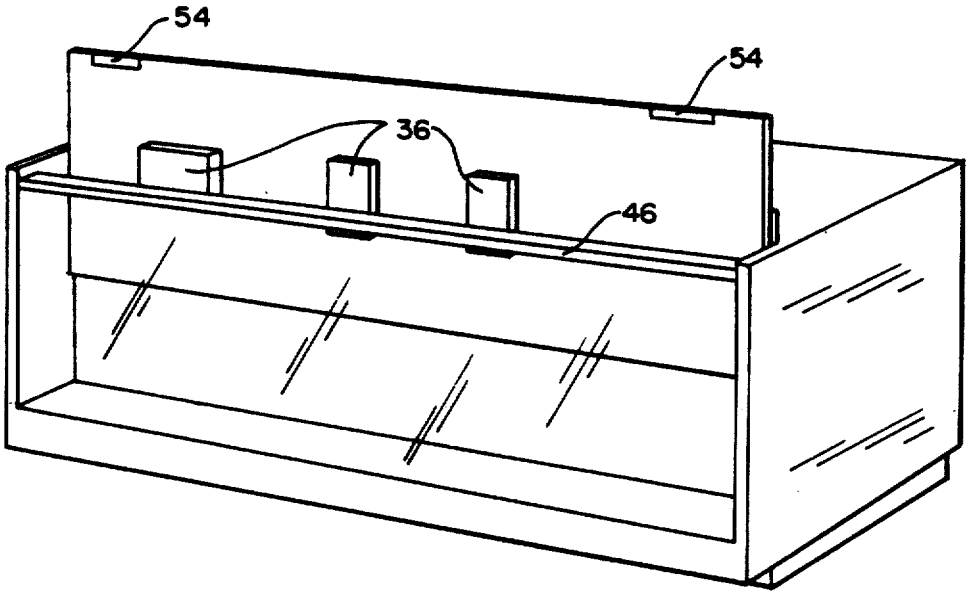
FIG. 2 is a perspective view of the merchandise display unit of FIG. 1 showing the merchandise display wall partially removed therefrom.
Figure 4:
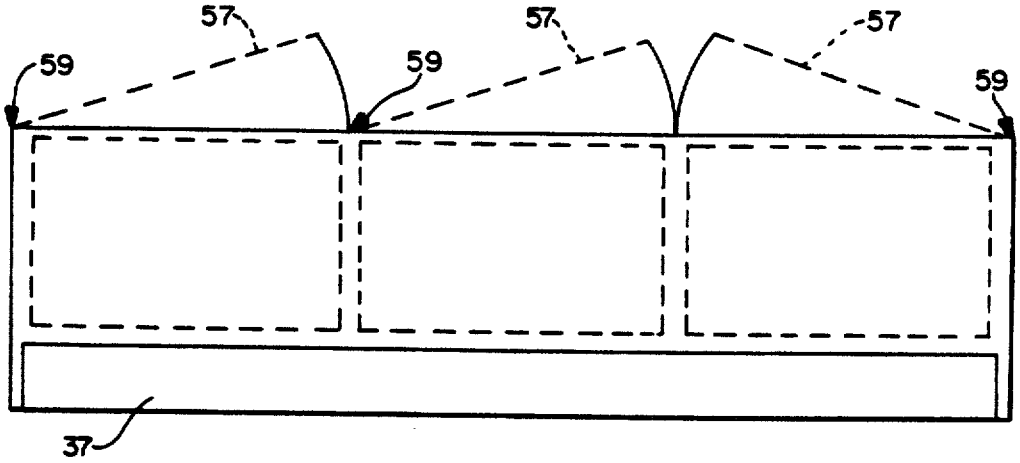
FIG. 4 is a top plan view thereof showing the hinged positions of the rear storage area doors.
Figure 3:
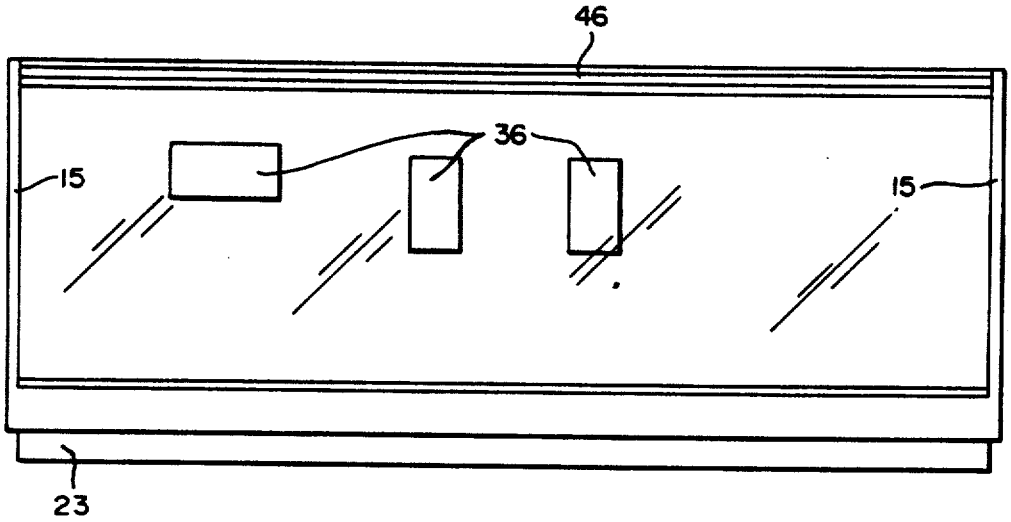
FIG. 3 is a front elevational view of the merchandise display unit of FIG. 1.
Figure 5:
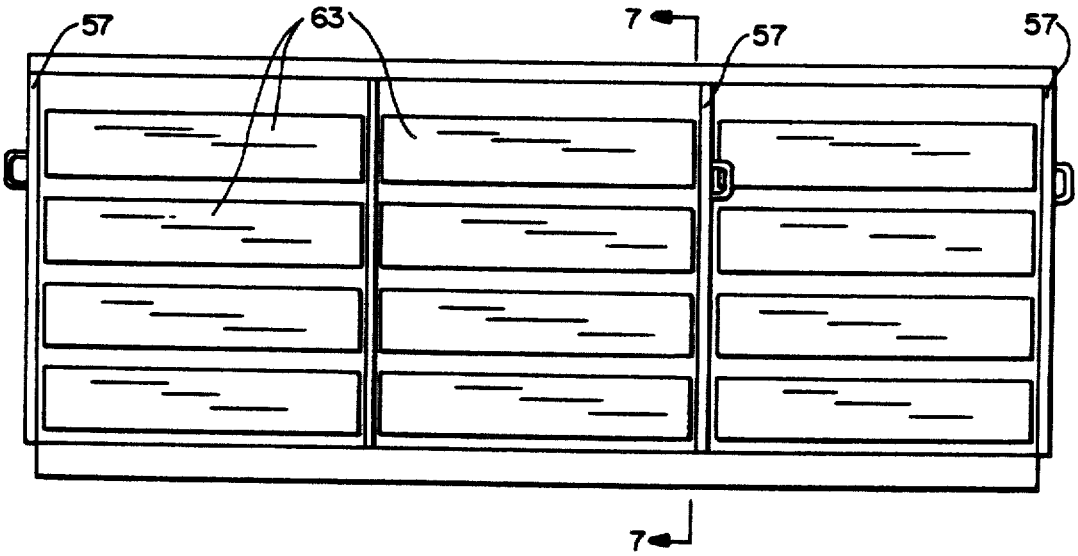
FIG. 5 is a rear elevational view thereof with the storage doors open.
Figure 6:
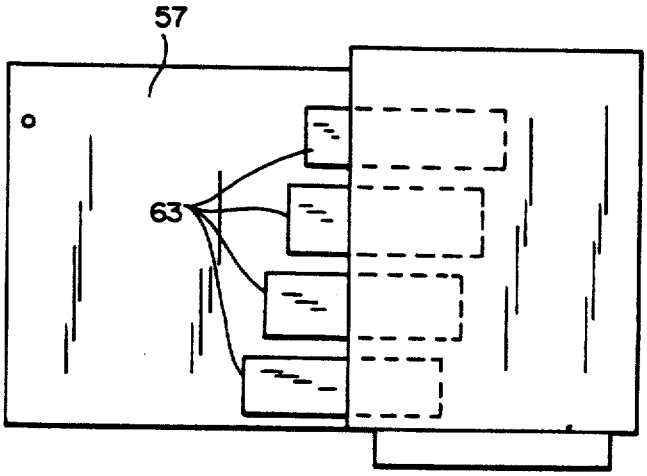
FIG. 6 is a side elevational view thereof showing the rear storage area doors open and the storage drawers partially pulled out of the storage area.

With further reference to FIG. 7, a bottom channel support element 51 extends along the display area floor 33 against the partition wall 29 to hold the base 32 of the display wall, which, as generally illustrated in FIG. 2, is removable through the access opening 35. The display wall is additionally secured in its vertical position at the top of the partition wall by means of a releasable attachment means, such as by Velcro fasteners 53 adhered to both the back of the display wall and the front of the partition wall. Handle means, such as handles 54 secured to the top of the display wall, facilitate the removal of the display wall from the display area through the access opening.

The front of the display wall 31 is provided with a merchandise attachment means, suitably a hook-and-loop compatible carpet or fabric material 55, which cover substantially the entire area of the display wall and to which an item of merchandise provided with a backing strip of Velcro or the like can be releasably adhered In this fashion, display items, such as light, empty video cassette containers 36, can be placed anywhere on the display wall to create a wide variety of different display arrangements.

The storage area 27 behind the partition wall 29 is not accessible through the display area 25, but must be accessed through multiple rear storage area doors 57 which are hinged at 59 and which are suitably provided with security locks 61. Alternatively, sliding panel doors could be used. Stacked storage drawers 63, which can be pulled open from the rear, provide multiple compact and suitably sized storage spaces. For instance, to maximize storage the drawers can be sized to exactly hold standard sized video cassette boxes. The storage area could alternatively be provided with shelves, or could be completely open or have a combination of shelves, drawers and open space to accommodate a variety of storage needs.

To use the illustrated merchandise display unit, and particularly to change a display therein, the salesperson simply unlocks the top access door 37 by means of the key lock 41, and then, after opening the access door, pulls the display wall 31 slightly forward by means of handles 54. The display wall is then simply lifted up through the access opening as shown in FIG. 2. With the display wall removed or partially removed from the top of the display unit, the salesperson can easily change or rearrange the display on the display wall, after which the display wall is replaced to its original position in the display area by inserting the base 32 of the display wall in the channel support 51 and reattaching the top of the display wall to the partition wall by means of the Velcro fasteners 53.

It can therefore be seen that the present invention is a merchandise display unit which, on the one hand, provides for an easily accessed and usable display area, while on the other hand offers ample secured storage space which cannot be reached through the display area. The merchandise display unit of the invention will handle a high volume of over the counter sales without the need to continually restock the counter, and will also provide a unit which will lower the risk of theft. While the present invention has been described in considerable detail in the foregoing specification, it will be understood that the invention is not intended to be limited to such detail, except as necessitated by the following claims.

I claim:

1. A merchandise display unit comprising an enclosure having a generally defined front wall area and a front display opening in said enclosure front wall area, partitioning wall means including a substantially vertical and removable display wall, said partitioning wall means being positioned internally of said enclosure relatively close behind said front display opening so as to divide said enclosure into a relatively shallow front display area and a relatively deep, rear accessible, rear storage area, the front of said vertical display wall having merchandise attachment means for removable attaching merchandise thereon for displaying said merchandise behind said front display opening, and a display area access opening in said enclosure to permit access to and removal of the display wall portion of said partitioning display wall means.

2. The merchandise display unit of claim 1 wherein said display area access opening is an elongated opening in the top of said enclosure over said display area whereby said display wall means can be removed by lifting same up through said access opening from the front of said enclosure.

3. The merchandise display unit of claim 2 wherein handle means are provided proximate the top said removable display wall to facilitate the removal of same.

4. The merchandise display unit of claim 1 wherein said partitioning wall means includes a fixed, substantially vertical internal partition wall behind said removable display wall, said partition wall acting to isolate said display area from said storage area when said display wall is removed.

5. A merchandise display unit comprising an enclosure having a top, a generally defined front wall area, and a front display opening in said enclosure front wall area, partitioning wall means positioned internally of said enclosure relatively close behind said front display opening so as to divide said enclosure into a relatively shallow front display area and a relatively deep, rear accessible, rear storage area, said partitioning wall means including a fixed, substantially vertical partition wall and a substantially vertical removable display wall, and a display area access door in the top of said enclosure over said display area to permit access to and removal of said removable display wall.

6. The merchandise display unit of claim 1 wherein a display light is provided in said front display area for illuminating said removable display wall and merchandise attached thereto.

7. The merchandise display unit of claim 1 wherein said merchandise attachment means on said removable display wall is comprised of a hook and loop compatible attachment material.

* * * * *